United States Patent [19]

Ohtaki et al.

[11] Patent Number: 4,651,695

[45] Date of Patent: Mar. 24, 1987

[54] AIR-FUEL RATIO CONTROL SYSTEM

[75] Inventors: Kiyoshi Ohtaki, Fuchu; Kazuo Hara, Musashino, Japan

[73] Assignee: Fugi Jukogyo Kabushiki Kaisha, Tokyo, Japan

[21] Appl. No.: 787,396

[22] Filed: Oct. 15, 1985

[30] Foreign Application Priority Data

Oct. 22, 1984 [JP] Japan ..... 59-222631

[51] Int. Cl.[4] ..... F02M 41/00; F02M 71/00

[52] U.S. Cl. ..... 123/438; 123/440; 123/489; 123/492; 123/493

[58] Field of Search ..... 123/438, 440, 472, 480, 123/492, 493, 478, 489

[56] References Cited

U.S. PATENT DOCUMENTS

| | | | |
|---|---|---|---|
| 3,831,564 | 8/1974 | Schmidt et al. | 123/440 |
| 4,029,061 | 6/1977 | Asano | 123/440 |
| 4,046,118 | 9/1977 | Aono | 123/438 |
| 4,057,042 | 11/1977 | Aono | 123/438 |
| 4,089,313 | 5/1978 | Asano et al. | 123/440 |
| 4,361,124 | 11/1982 | Nakamura | 123/438 |
| 4,416,236 | 11/1983 | Morozumi et al. | 123/438 |
| 4,465,048 | 8/1984 | Morozumi et al. | 123/438 |

*Primary Examiner*—Raymond A. Nelli
*Attorney, Agent, or Firm*—Martin A. Farber

[57] ABSTRACT

An air-fuel ratio control system for an internal combustion engine has an electromagnetic valve for correcting the air-fuel ratio of air-fuel mixture, an $O_2$ sensor for detecting oxygen concentration in exhaust gases, and a feedback control circuit including a PI circuit, and a pulse generating circuit responsive to the output of the PI circuit for generating pulses, the duty ratio of which is dependent on the output of the PI circuit. A steady state detecting circuit is provided for producing a steady state signal when the magnitude of acceleration of the engine is within a predetermined range. The constant of the PI circuit is decreased by the steady state signal for preventing overshooting of the air-fuel ratio control.

5 Claims, 5 Drawing Figures

AIR-FUEL RATIO CONTROL SYSTEM

BACKGROUND OF THE INVENTION

The present invention relates to an air-fuel ratio control system for an internal combustion engine, which system controls the air-fuel mixture to the stoichiometric air-fuel ratio at which ratio a three-way catalyst acts most effectively.

In a known air-fuel ratio control system for a motor vehicle, the air-fuel ratio of the air-fuel mixture burned in the engine cylinders is detected as the oxygen concentration in the exhaust gases by means of an $O_2$ sensor provided in the exhaust system of the engine, and a decision is made dependent on the output signal from the $O_2$ sensor which indicates whether the air-fuel ratio is richer or leaner than the value corresponding to the stoichiometric air-fuel ratio, for producing a control signal. The control signal is applied to a proportion and integration circuit (PI circuit), the output of which is applied to a comparator. The comparator compares the output of the PI circuit with a triangular pulse train to produce square wave pulses. The pulses operate an electromagnetic valve so as to control the amount of bleed air in a carburetor for controlling the air-fuel ratio of the mixture.

FIG. 3 shows waveforms at the comparator. Reference PI designates an output of the PI circuit (hereinafter called PI value) and T shows the triangular pulse train. The comparator produces square pulses SP as a result of the comparison. As seen from the figure, the duty ratio of the square pulses is determined by the level of the PI value. The inclination of the PI value increases with the increase of the constant of the PI circuit. Accordingly, if the constant is increased, the duty ratio quickly changes. When the duty ratio of the pulses is reduced, the air-fuel mixture is enriched. Thus, the air-fuel ratio can be controlled to the stoichiometric air-fuel ratio at which a three-way catalyst in the exhaust system acts most effectively. In such an air-fuel ratio control system, when the vehicle is accelerated, the air-fuel ratio is liable to deviate from the stoichiometric air-fuel ratio.

In order to rapidly converge the deviated air-fuel ratio to the stoichiometric air-fuel ratio, the constant of the PI circuit is changed to a large value. The constant of the PI circuit is stepwisely changed to several values in accordance with driving conditions of the vehicle. The constant of the PI circuit is decreased to a small value at engine idling operation, because the air-fuel ratio does not vary much at idling.

Accordingly, there is provided a first constant for idling operation, second constant for steady state at which the vehicle is driven at a constant speed, and third constant for acceleration of the engine. The second constant is selected to have a value between the first and third constants.

On the other hand, generally, a carburetor does not have a flat load characteristic. Namely, when the engine is accelerated, the supply of fuel delays, rendering the air-fuel mixture lean. Accordingly, if the engine is accelerated during operation within an acceleration range controlled by the second constant, the air-fuel ratio does not quickly respond to the acceleration because of the small constant. However, if the second constant is set to a larger value, the air-fuel ratio changes a lot in response to a small acceleration. Such an operation causes overshooting of the feedback control, which renders the driveability of the vehicle and emission control poor.

SUMMARY OF THE INVENTION

The object of the present invention is to provide a system which may prevent overshooting of the air-fuel ratio control.

To this end, the system of the present invention is provided with a circuit for decreasing the constant of the PI circuit when a vehicle is driven in a steady state for a predetermined period.

The other objects and features of this invention will be apparently understood from the following description with reference to the accompanying drawings.

DETAILED DESCRIPTION OF THE PREFERRED EMBODIMENTS

Figure 1:
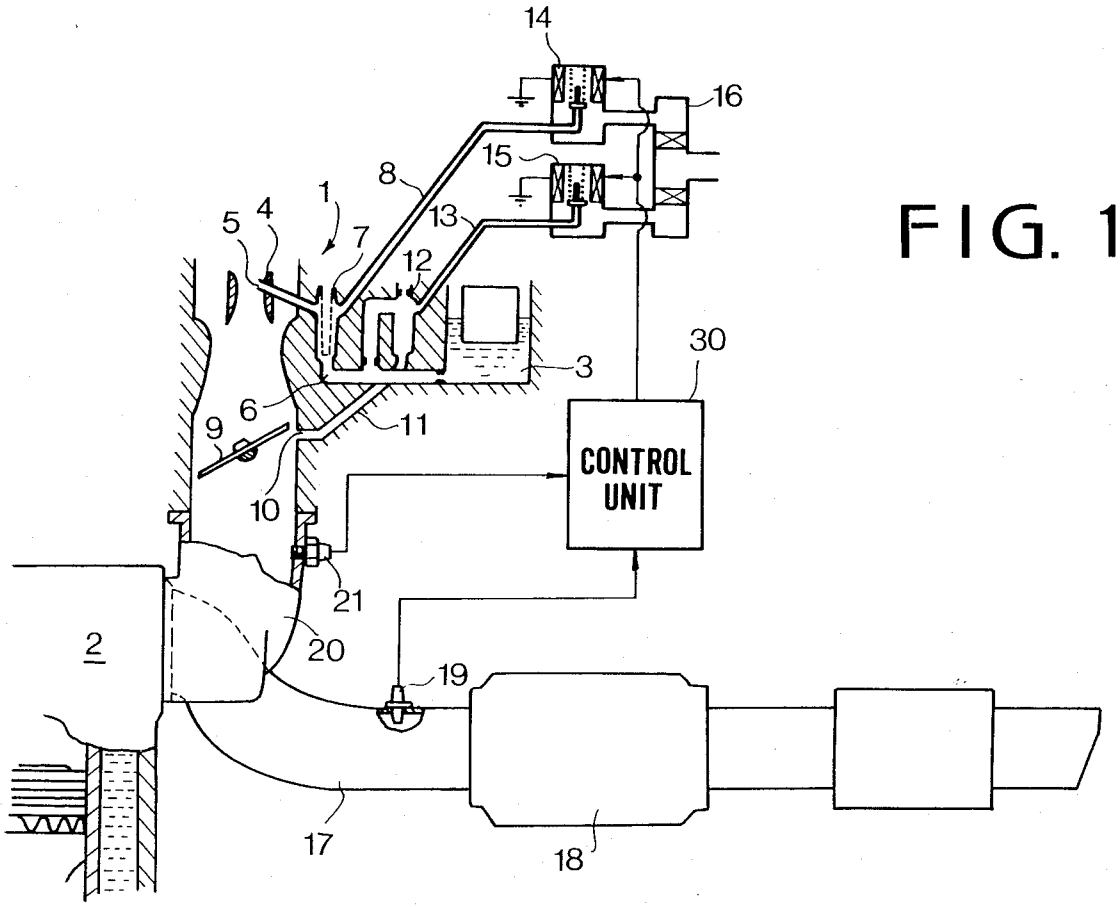
FIG. 1 is a schematic explanatory view of an air-fuel ratio control system according to the present invention.

Referring to FIG. 1, a carburetor 1 is provided adjacent to an intake manifold (induction passage) 20 of an internal combustion engine 2. A correcting air passage 8 communicates with an air-bleed 7 which is provided in a main fuel passage 6 between a float chamber 3 and a nozzle 5 in a venturi 4. Another correcting air passage 13 communicates with another air-bleed 12 which is provided in an idle fuel passage 11 which diverges from the main fuel passage 6 and extends to an idle port 10 in the vicinity of a throttle valve 9. These correcting air passages 8 and 13 communicate with on-off type electromagnetic valves 14, 15, the induction sides of which are in communication with the atmosphere through an air filter 16. A three-way catalytic converter 18 is provided in an exhaust pipe 17 downstream of the engine, and an $O_2$ sensor 19 is provided in the exhaust pipe 17 between the engine 2 and the converter 18 to detect the oxygen concentration of exhaust gases when the air-fuel mixture is burned in the engine. A vacuum sensor 21 is provided in the intake manifold 20 downstream of the throttle valve 9.

The outputs of the $O_2$ sensor 19 and vacuum sensor 21 are sent to a control unit 30 which produces pulses to actuate the electromagnetic valves 14, 15 to open and close them at duty ratios. Thus, either considerable air is supplied to the fuel system through the air correcting passages 8, 13 to produce a lean air-fuel mixture or only a small amount of air is supplied to the system so as to enrich the air-fuel mixture.

Figure 2:
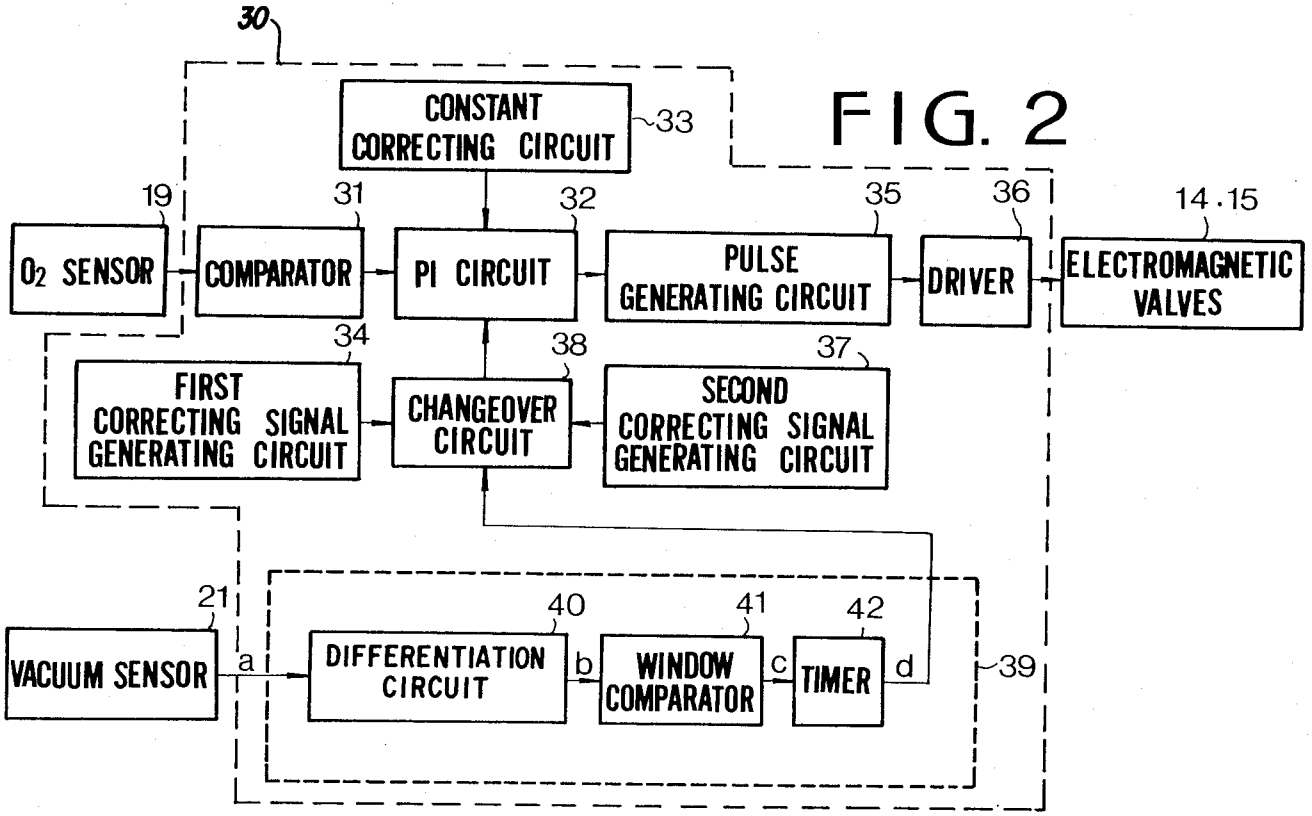
FIG. 2 shows a block diagram of the electric control circuit of the present invention.

FIG. 2 shows the construction of the control unit 30 including a feedback control circuit. The output of the $O_2$ sensor 19 is applied to a PI (proportion and integration) circuit 32 through a comparator 31.

Figure 3:
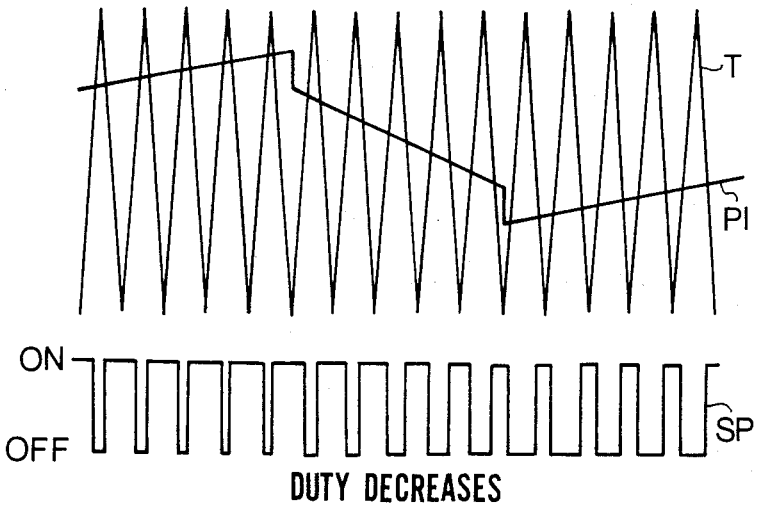
FIG. 3 shows waveforms of the outputs of a PI circuit and a comparator.

Generally, the air-fuel ratio varies cyclically with respect to the stoichiometric air-fuel ratio. Accordingly, the output of the $O_2$ sensor 19 has a waveform having a constant wavelength. The output is compared with a reference value at the comparator 31 which produces pulses dependent on the waveform. The pulses are applied to the PI circuit 32, so that the PI circuit produces an output signal having a waveform as shown by the reference PI in FIG. 3. The output of the PI circuit 32 is applied to a pulse generating circuit 35 which compares the output of the PI circuit 32 with triangular wave pulses T to produce square wave pulses SP as shown in FIG. 3. The square wave pulses are supplied to the electromagnetic valves 14, 15 via a driver 36 for operating the valves.

When a rich air-fuel mixture is detected, the PI circuit 32 produces a positive-going PI value, so that the duty ratio of the pulses SP becomes large as shown in FIG. 3 so as to dilute the mixture. At a lean air-fuel mixture, the PI circuit produces a negative going PI value, which causes the duty ratio to decrease to enrich the mixture.

The PI circuit 32 is connected with a constant correcting circuit 33 which produces various constant correcting signals including a constant for idling and a constant for acceleration.

Figure 5:
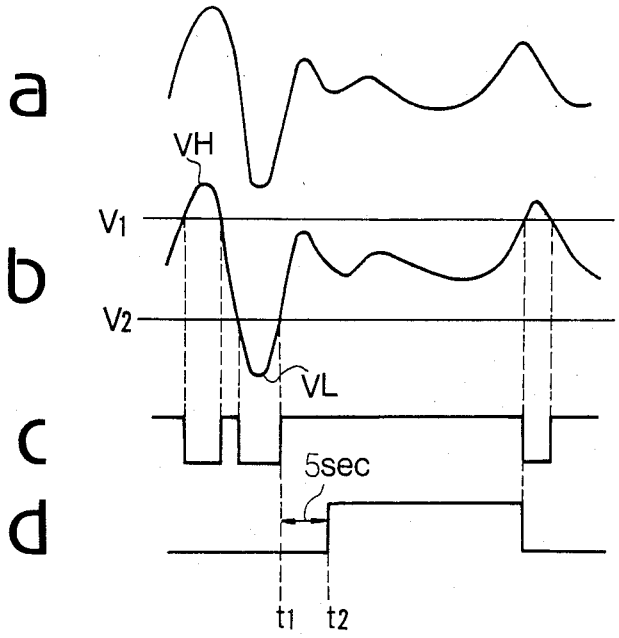
FIGS. 5(*a*) to 5(*d*) show waveforms at points of the system of FIG. 2.

Further, the PI circuit 32 is electrically connected to a first and second correcting signal generating circuits 34 and 37 through a changeover circuit 38, respectively. The first correcting signal generating circuit 34 produces a first constant correcting signal for steady state at which the vehicle is driven at a substantially constant speed, and the second correcting signal generating circuit 37 produces a second constant correcting signal for small acceleration at steady state. Namely, the first constant correcting signal causes the constant of the PI circuit 32 to change to a smaller value, and the second constant correcting signal causes the constant to change to a larger value compared with the first constant correcting signal. The changeover switch 38 is operated by an output d of an acceleration detecting circuit 39. The circuit 39 comprises a differentiation circuit 40 which is supplied with the output a of vacuum sensor 21. The output b of the differentiation circuit 40 is applied to a window comparator 41 which produces a high level output when the output of the differentiation circuit 40 is in the range between reference voltages $V_1$ and $V_2$ (FIG. 5). The output c of the window comparator 41 is applied to a timer 42 which is responsive to the high level output of the comparator 41 to produce a high level output when the high level input from the comparator 41 continues for a predetermined period (5 sec.). The high level output of the timer 42 is applied to the changeover circuit 38, causing the connection of the output of the circuit 34 to the PI circuit 32.

In operation, the constant of the PI circuit 32 is corrected by the constant correcting signal from the circuit 33, 34 or 37 in accordance with driving conditions. When rich air-fuel mixture is detected, PI circuit 32 produces a positive going PI value, so that pulses having large duty ratios are produced from the circuit 35. Thus, the air-fuel mixture is diluted.

Referring to FIG. 5 when the engine is accelerated or decelerated in a magnitude, which is not so large to apply a large constant from the circuit 33, the intake manifold vacuum and the output of the circuit 40 vary as shown by references $V_L$ and $V_H$. The levels of the voltage are out of the range between $V_1$ and $V_2$ of the window comparator 41. Accordingly, the output of the comparator is at a low level. Therefore, the output of the timer 42 is at a low level, which operates the changeover circuit 38 to connect the output of the circuit 37 to the PI circuit 32. Thus, the constant of the PI circuit is set to a larger value. When the output voltage of the circuit 40 is within the range of $V_1-V_2$, which means the steady state of the engine, the comparator 41 produces a high level output at $t_1$ of FIG. 5(*c*). When the high level output continues for 5 sec., the timer 42 produces a high level output at $t_2$ of FIG. 5(*d*). The high level output operates the changeover circuit 38 to connect the output of the circuit 34 to the PI circuit 32. Thus, the constant of the PI circuit is set to a smaller value than that provided by the circuit 37, whereby the overshooting of the air-fuel ratio control can be prevented.

Figure 4:
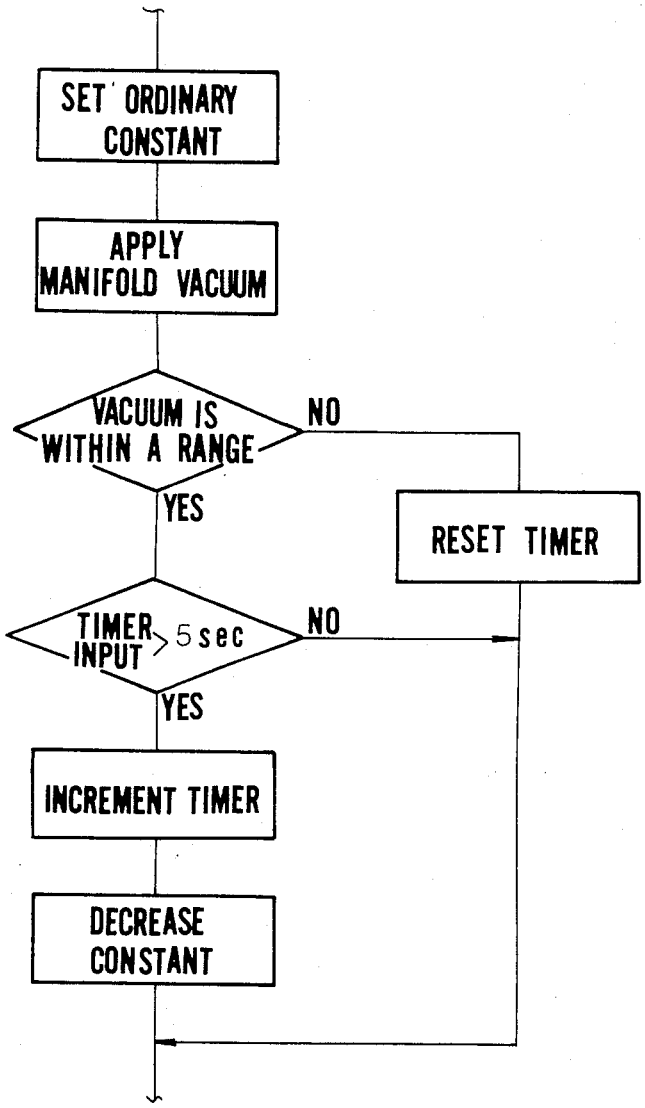
FIG. 4 shows a flowchart showing the operation of another embodiment of the present invention.

FIG. 4 shows operation of another embodiment of the present invention, which is comprised of a microcomputer system.

While the presently preferred embodiments of the present invention has been shown and described, it is to be understood that this disclosure is for the purpose of illustration and that various changes and modifications may be made without departing from the scope of the invention as set forth in the appended claims.

What is claimed is:

1. In an air-fuel ratio control system for an internal combustion engine having an induction passage, means for supplying air-fuel mixture to the engine, an electromagnetic valve for correcting the air-fuel ratio of the air-fuel mixture supplied by the supply means, an $O_2$ sensor for detecting oxygen concentration in exhaust gases of the engine, and a feedback control circuit including the following, comparator means for comparing the output of the $O_2$ sensor with a reference value for producing a first output signal, PI circuit means responsive to the first output signal of the comparator means for producing a PI value, the PI circuit means having a constant, and pulse generating circuit means responsive to the PI value for generating pulses having a duty ratio which is dependent on the PI value, the pulses being for driving the electromagnetic valve to correct the air-fuel ratio, the feedback control circuit operatively connected to said $O_2$ sensor and to said electromagnetic valve performing closed loop air-fuel ratio feedback control, the improvement in the system comprising:

engine operating condition detecting means responsive to pressure in the induction passage for producing a second output signal dependent on the pressure;

engine acceleration detecting means responsive to the second output signal for producing a first acceleration signal when fluctuation of the second output signal is within a predetermined range and continues for a predetermined time, and for producing a second acceleration signal when the fluctuation is out of the predetermined range;

first correcting means responsive to the first acceleration signal for setting the constant of the PI circuit means to a small value while the feedback control circuit is operatively connected to said $O_2$ sensor and to said electromagnetic valve performing closed loop air-fuel ratio feedback control; and second correcting means responsive to the second acceleration signal for setting the constant of the PI circuit means to a larger value than that provided by the first acceleration signal while the feedback control circuit is operatively connected to said $O_2$ sensor and to said electromagnetic valve performing closed loop air-fuel ratio feedback control, whereby overshooting of air-fuel ratio control is prevented when the fluctuation of the second output signal is within the predetermined range for the predetermined time.

2. The system according to claim 1, wherein said engine operating condition detecting means is a vacuum sensor.

3. The system according to claim 1, wherein said engine acceleration detecting means comprises a differentiation circuit, a window comparator and a timer connected in series.

4. The system according to claim 1, wherein said first and second correcting means include a common changeover circuit connected to said engine acceleration detecting means.

5. In an air-fuel ratio control system for an internal combustion engine having an induction passage, means for supplying air-fuel mixture to the engine, an electromagnetic valve for correcting the air-fuel ratio of the air-fuel mixture suppled by the supply means, and $O_2$ sensor for detecting oxygen concentration in exhaust gases of the engine, and a feedback control circuit including the following, comparator means for comparing the output of the $O_2$ sensor with a reference value for producing an output signal, PI circuit means responsive to the output signal of the comparator means for producing a PI value, the PI circuit means having a constant, and pulse generating circuit means responsive to the PI value for generating pulses having a duty ratio which is dependent on the PI value, the pulses being for driving the electromagnetic valve to correct the air-fuel ratio, the feedback control circuit operatively connected to said $O_2$ sensor and to said electromagnetic valve performing closed loop air-fuel ratio feedback control, the improvement in the system comprising:

engine acceleration detecting means for producing a first acceleration signal when fluctuation of an engine operating condition is within a predetermined range and continues for a predetermined time, and for producing a second acceleration signal when the fluctuation is out of the predetermined range;

first correcting means responsive to the first acceleration signal for setting the constant of the PI circuit means to a small value while the feedback control circuit is operatively connected to said $O_2$ sensor and to said electromagnetic valve performing closed loop air-fuel ratio feedback control; and second correcting means responsive to the second acceleration signal for setting the constant of the PI circuit means to a larger value than that provided by the first acceleration signal while the feedback control circuit is operatively connected to said $O_2$ sensor and to said electromagnetic valve performing closed loop air-fuel ratio feedback control, whereby overshooting of air-fuel ratio control is prevented when the fluctuation is within the predetermined range for the predetermined time.

* * * * *